US009048535B1

(12) United States Patent
Desclos et al.

(10) Patent No.: US 9,048,535 B1
(45) Date of Patent: Jun. 2, 2015

(54) TRANSMIT AND RECEIVE LOW BAND ANTENNA

(71) Applicants: Laurent Desclos, San Diego, CA (US); Sebastian Rowson, San Diego, CA (US); Jeffrey Shamblin, San Marcos, CA (US); Xiaomeng Su, San Diego, CA (US)

(72) Inventors: Laurent Desclos, San Diego, CA (US); Sebastian Rowson, San Diego, CA (US); Jeffrey Shamblin, San Marcos, CA (US); Xiaomeng Su, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 14/082,096

(22) Filed: Nov. 15, 2013

Related U.S. Application Data

(63) Continuation-in-part of application No. 13/118,373, filed on May 28, 2011, now abandoned, which is a continuation-in-part of application No. 12/758,662, filed on Apr. 12, 2010, now Pat. No. 8,421,695.

(51) Int. Cl.
*H01Q 9/16* (2006.01)
*H01Q 3/24* (2006.01)

(52) U.S. Cl.
CPC ..... *H01Q 3/24* (2013.01)

(58) Field of Classification Search
USPC ..... 343/745–748
See application file for complete search history.

(56) References Cited

U.S. PATENT DOCUMENTS

2005/0030122 A1* 2/2005 Nation ..... 333/104
2005/0040991 A1* 2/2005 Crystal ..... 343/747
2010/0259457 A1* 10/2010 Friman et al. ..... 343/747

* cited by examiner

*Primary Examiner* — Matthew Mikels
(74) *Attorney, Agent, or Firm* — Coastal Patent Law Group, P.C.

(57) ABSTRACT

A multi-frequency, noise optimized active antenna capable of transmit and receive operation consisting of one or several actively tuned antennas optimized over incremental bandwidths and capable of tuning over a large total bandwidth. One or several switches are integrated and provide the capability of operation of an active antenna for both transmit and receive functions. One or multiple impedance transformers are connected to the antennas at an optimal location, with the transformers acting to reduce the impedance for optimal coupling to a transceiver/receiver. Active components can be incorporated into the antenna structures to provide yet additional extension of the bandwidth along with increased optimization of antenna performance over the frequency range of the antenna. The radiating elements can be co-located with a ferrite material and/or active components coupled to the element to tune across a wide frequency range.

14 Claims, 8 Drawing Sheets

TRANSMIT AND RECEIVE LOW BAND ANTENNA

CROSS REFERENCE TO RELATED APPLICATIONS

This application is a continuation in part (CIP) of U.S. patent application Ser. No. 13/118,373, filed May 28, 2011, and titled "TRANSMIT RECEIVE LOW BAND ANTENNA";

which is a continuation in part (CIP) of U.S. patent application Ser. No. 12/758,662, filed Apr. 12, 2010, and titled "MULTI-FREQUENCY, NOISE OPTIMIZED ACTIVE ANTENNA";

the contents of each of which are hereby incorporated by reference.

BACKGROUND OF THE INVENTION

1. Field of the Invention

The claimed invention relates generally to antennas for wireless communication; and more particularly, to such antennas configured for transmit and receive function in low frequency applications, including FM radio.

2. Description of the Related Art

The continual search for additional frequency bandwidth and efficiency from antennas in wireless systems points to the need for new approaches. Increasing frequency bandwidth of internal antennas for media applications in cell phones is a prime example. More specifically, internal antennas for FM radio reception in mobile devices are becoming increasingly common. Antenna performance is a key parameter for good reception quality. Mobile handsets are very small compared to wavelengths at FM frequencies; thus the antennas used for these applications on handsets will be electrically small. These electrically small antennas will be narrow band and require low loss matching techniques to preserve efficiency. Multiple electrically small antennas embedded in a small wireless device will tend to couple, thereby degrading performance. The reduced volume allowed for an internal antenna coupled with the fact that the internal FM antennas must not interfere with the main antenna or other ancillary antennas in the handset makes the task of antenna matching across the wide range of frequencies quite difficult.

In order to achieve good efficiency from an internal antenna required to cover the large FM frequency band, one solution is to actively tune the antenna over narrow instantaneous bandwidths. Compared to an antenna structure that covers the whole frequency range without tuning, the tunable antenna greatly improves the antenna radiation efficiency for the same physical volume constraint. Additional active tuned loops can be combined to extend the frequency range to cover wider bandwidths, thereby satisfying a wide range of antenna applications. With the ability to cover multiple octaves, FM and other media applications can be addressed with internal antennas which will provide the required efficiency.

The task of integrating an internal FM antenna into a mobile phone or other mobile device becomes more challenging when a transmit function is required in addition to the receive function. A current application involves the use of an FM transmitter in a portable device that plugs into the headphone jack or other port of a portable audio or video device, such as a portable media player, CD player, or satellite radio system. The sound is then broadcast through the transmitter, and plays through an FM broadcast band frequency. Purposes for an FM transmitter include playing music from a device through a car stereo, or any radio.

The FM-transmitter can be designed to plug into the audio output of audio devices and converts the audio output into an FM radio signal, which can then be picked up by appliances such as car or portable radios. Most devices on the market have a short range of up to 30 feet (9 meters) with any average radio and can broadcast on any FM frequency from 76.0 to 108.0 MHz (or 88.1 to 107.9 in the US), and up to about 75 feet (23 meters) with a very good radio under perfect conditions. Some lower-cost transmitters are designed to operate over a restricted bandwidth which covers 87.7-91.9 MHz band allocated to educational broadcasts in the United States, or a certain other smaller range of frequencies.

FM transmitters are usually battery driven, but some use the cigarette lighter socket in cars, or draw their power from the device itself. A low power design is important for this reason. They are typically used with portable audio devices such as CD or MP3 players, but are also used to broadcast other outputs (such as that from a computer sound card) throughout a home or other building.

It would be beneficial to provide an antenna system that will support transmit and receive using a common antenna element.

SUMMARY OF THE INVENTION

In one embodiment, a multi-element antenna system is provided. The antenna system comprises a first active tuning component connected to a first antenna element. The first active tuning component provides a reactance that cancels the reactance of the first antenna element, allowing for optimal radiation. A second active tuning component is connected to a second antenna element. An impedance transformer is connected to the each of the first and second antenna elements at a point of high voltage, with the transformer acting to reduce the impedance for optimal coupling to a transmitter or receiver. The first active tuning component and the first antenna element are connected to the transmitter, whereas the second active tuning component and second antenna element are connected to the receiver.

In another embodiment of the invention, a switch assembly is connected to both the transmit and receive sections of the active antenna system and used to provide improved isolation between transmitter and receiver.

In yet another embodiment, multiple active tuned loops or coils are connected to extend the frequency range of the antenna. A single or multiple impedance transformers can be connected to multiple locations on the active antennas on the transmit or receive sections to provide connection of the antenna to a single or multiple transmitters and/or receivers.

Other embodiments will become apparent to those having skill in the art upon a review of the appended detailed description.

DETAILED DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Embodiments of the present invention provide an antenna system capable of transmit and receive operation, utilizing a tuned antenna element or elements and active impedance transformers.

Figure 1:
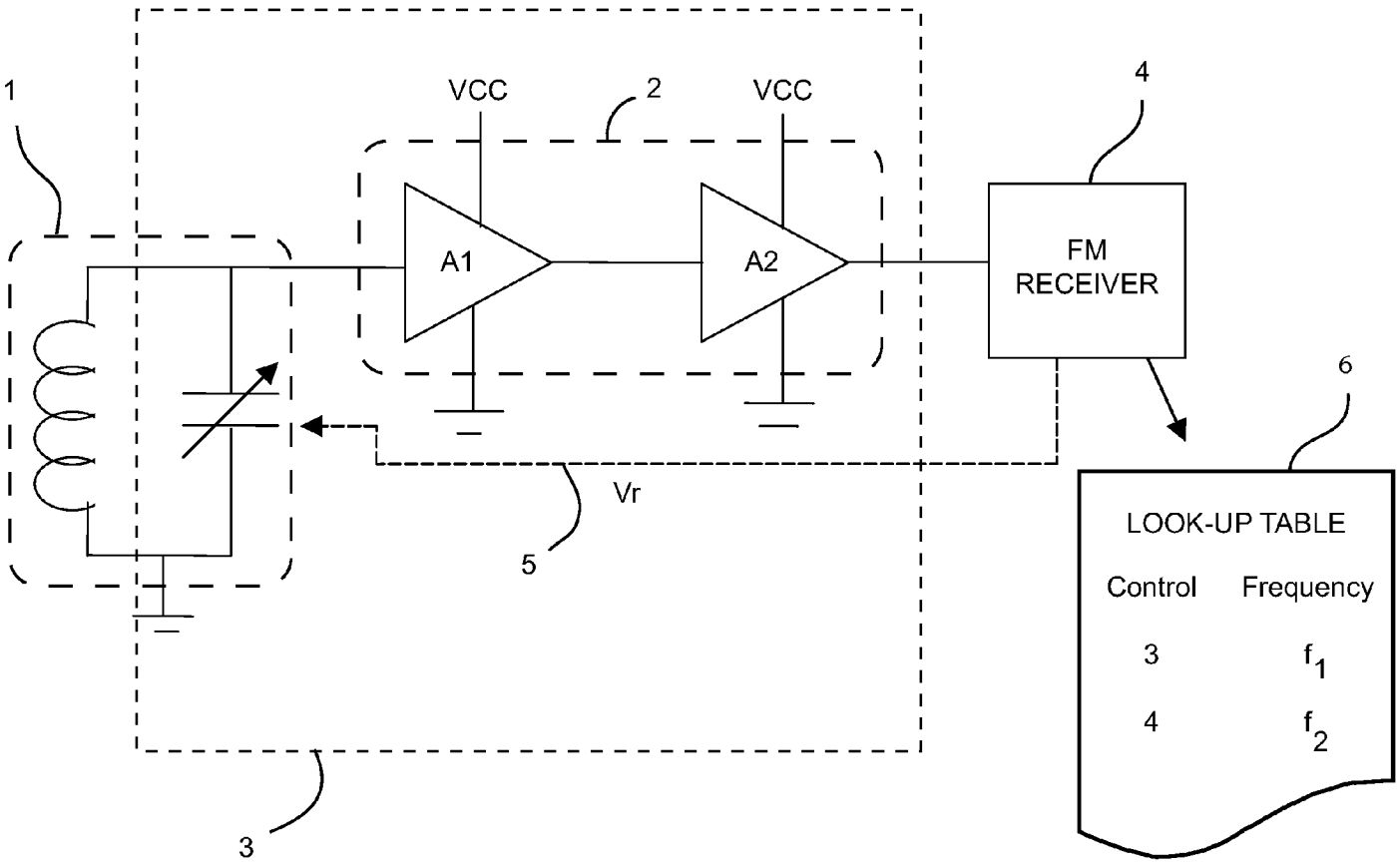
FIG. 1 illustrates an example of an FM receiver. A control signal is provided by the FM receiver to the active or tunable element based upon a look-up table.

FIG. 1 illustrates a functional diagram of a typical FM receiver proposed in commonly owned U.S. Ser. No. 12/758,662. An active tunable antenna element 1 is connected to an active impedance transformer 2 which combined with the tunable portion of the active tunable antenna provides an active module 3. This assembly is connected to a receiver 4. A control signal 5 is provided by the FM receiver to the active or tunable element based upon a look-up table.

Figure 2:
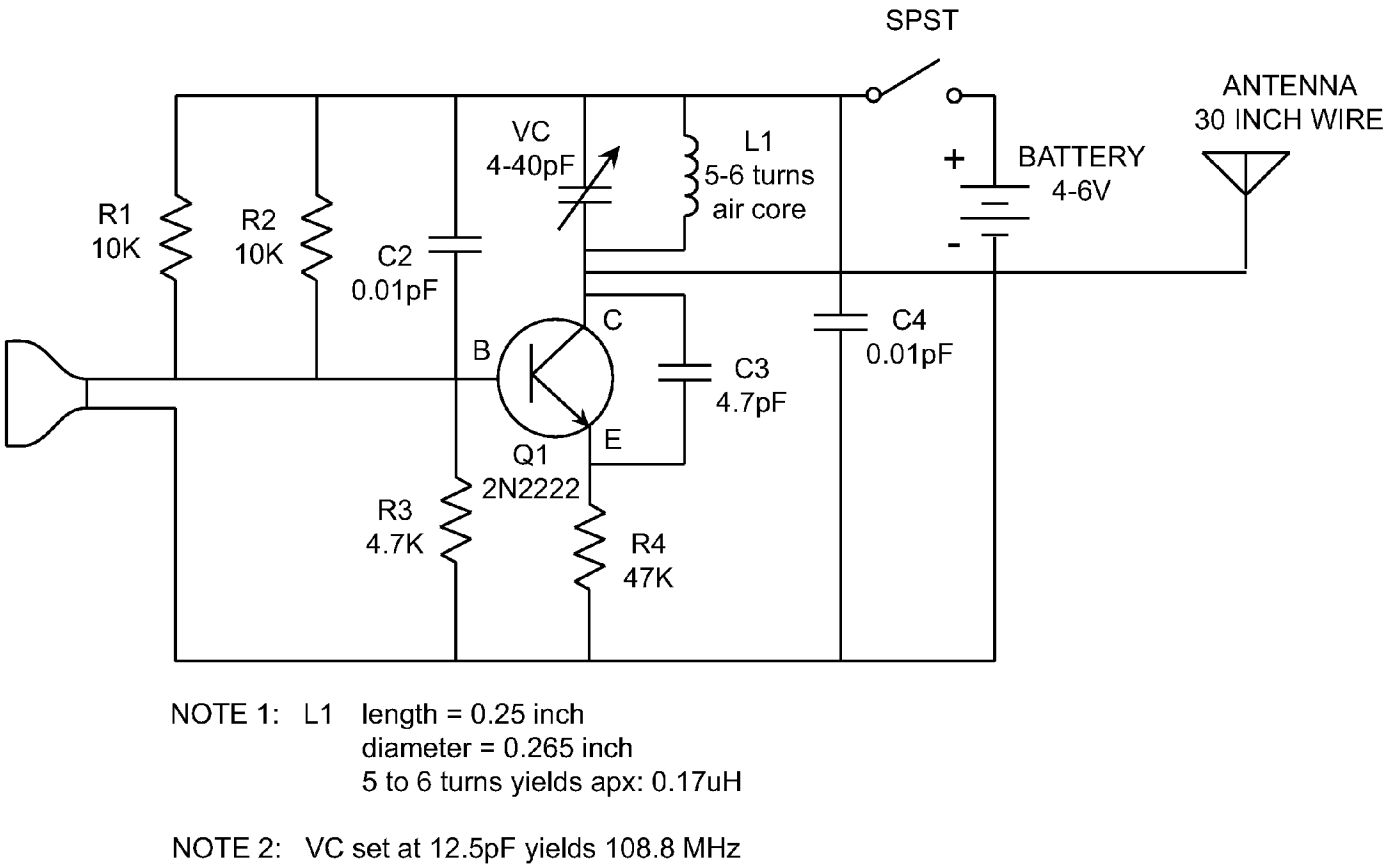
FIG. 2 illustrates a representation of a typical FM transmitter.

FIG. 2 illustrates a typical FM transmitter.

Figure 3A:
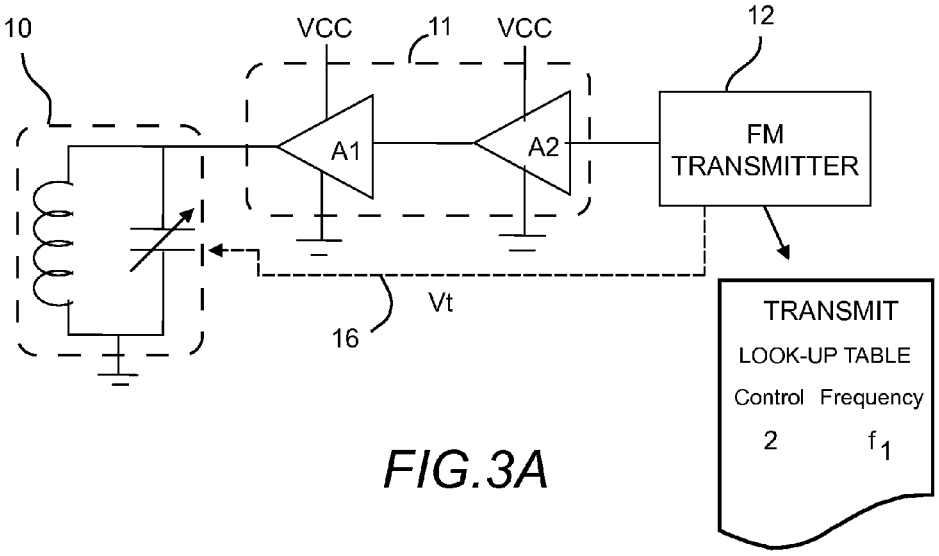
FIGS. 3(A-B) show a representation of separate transmit and receive active antennas, respectively. Different tunable antennas are used for transmit and receive, and the impedance transformers are optimized in each case to provide optimal coupling into or from the tunable antenna to either the transmitter or receiver. Control signals are provided by the FM transmitter and receiver to the active or tunable elements based upon look-up tables.
Figure 3B:
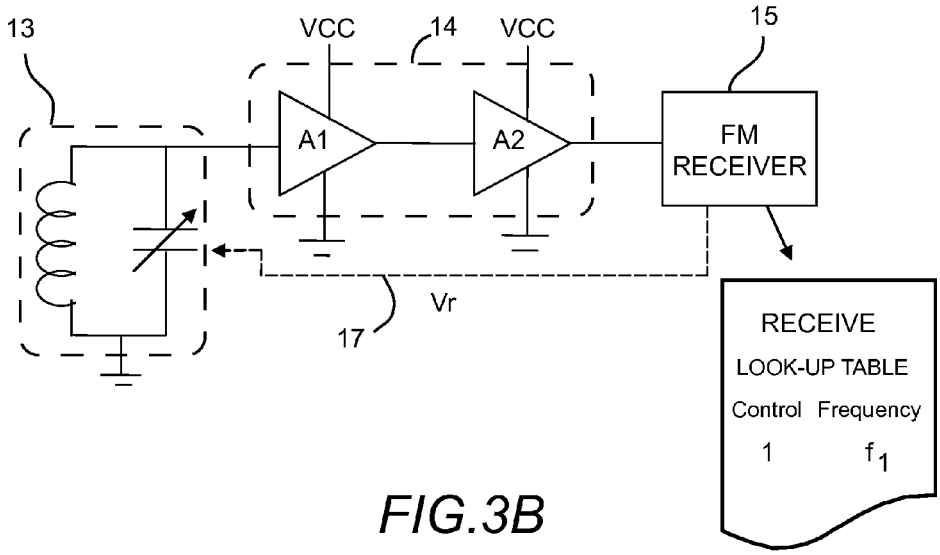

FIGS. 3(A-B) illustrate separate transmit and receive antennas prior to combining. A tunable antenna 10 is connected to an active impedance transformer 11 which is in turn connected to a transmitter 12. An active tunable antenna element 13 is connected to an active impedance transformer 14. This assembly is connected to a receiver 15. Control signals 16 and 17 are provided by the FM transmitter and receiver to the active or tunable elements based upon look-up tables.

Figure 4:
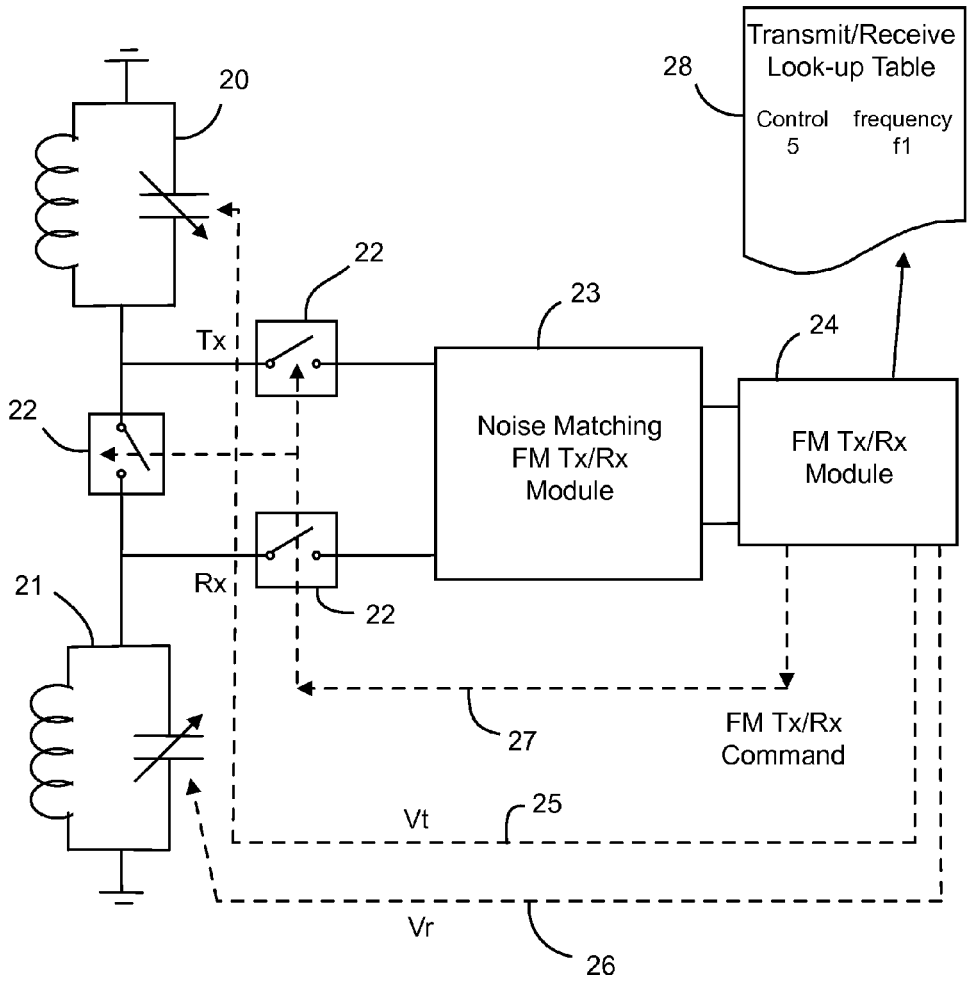
FIG. 4 illustrates an active antenna configuration that combines both transmit and receive antennas into a single circuit, with switch elements to provide isolation between the transmitter and receiver. The FM transmit/receive module provides control signals for the switch assembly and both active or tunable elements based upon a look-up table.

FIG. 4 illustrates an antenna system that provides both transmit and receive functions. Tunable antennas 20 and 21 are connected to a network of switches 22 defining a switch assembly which provides isolation between the transmit and receive signals. The switch assembly is connected to a noise matching FM transmit/receive module 23. An FM transmit/receive control module 24 is connected to the noise matching module and provides the function of controlling the switch assembly to change between transmit and receive operation. The FM transmit/receive module provides control signals 25, 26, and 27 for the switch assembly and both active or tunable elements based upon a look-up table 28, for example receiving voltage signal Vr and transmitting voltage signal Vt as illustrated.

Figure 5A:
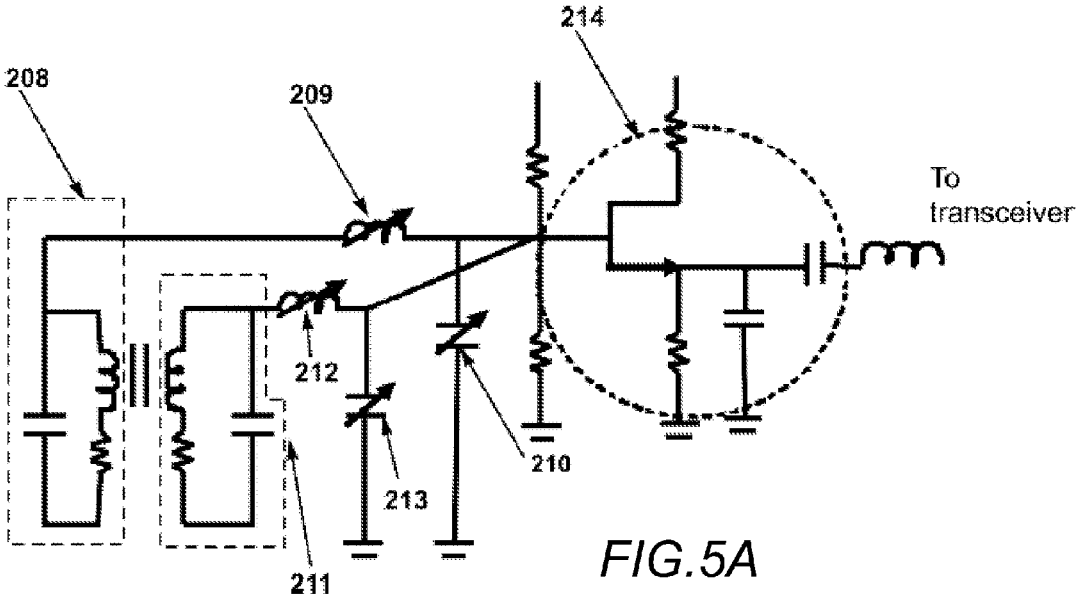
FIGS. 5(A-B) illustrate a proposed receive only structure proposed in a previous patent.
Figure 5B:
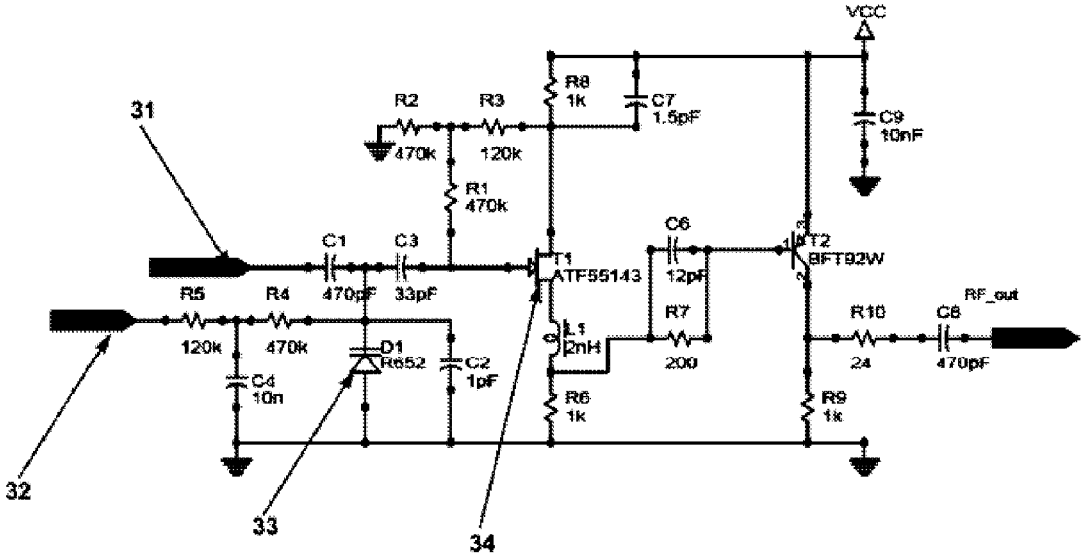

FIGS. 5(A-B) illustrate an embodiment of a circuit from commonly owned U.S. Ser. No. 12/758,662. Referring now to FIG. 5A, Antenna loops 208 and 211 are shown with their corresponding reactive and resistive elements. Active components 209 and 210 for loop 208 and 212 and 213 for loop 211 are used to tune each loop to its resonant frequency increasing the circuit efficiency and reducing the noise figure. Both circuits are connected to the impedance transformer 214. While this description is shown with two antenna loops, as many as physically possible may be included to satisfy design requirements. In FIG. 5B, another embodiment is illustrated where the antenna loop 31 is tuned using a control voltage 32 and an active tuning element such as a varactor diode 33 is used to vary the resonant frequency of the antenna loop within a range as defined by the reactive elements of the antenna loop. An impedance transformer circuit component 34 is used to match the tuned antenna loops to the receiver circuitry; for example, a MOSFET semiconductor, however, this may include any component used for this function.

Figure 6:
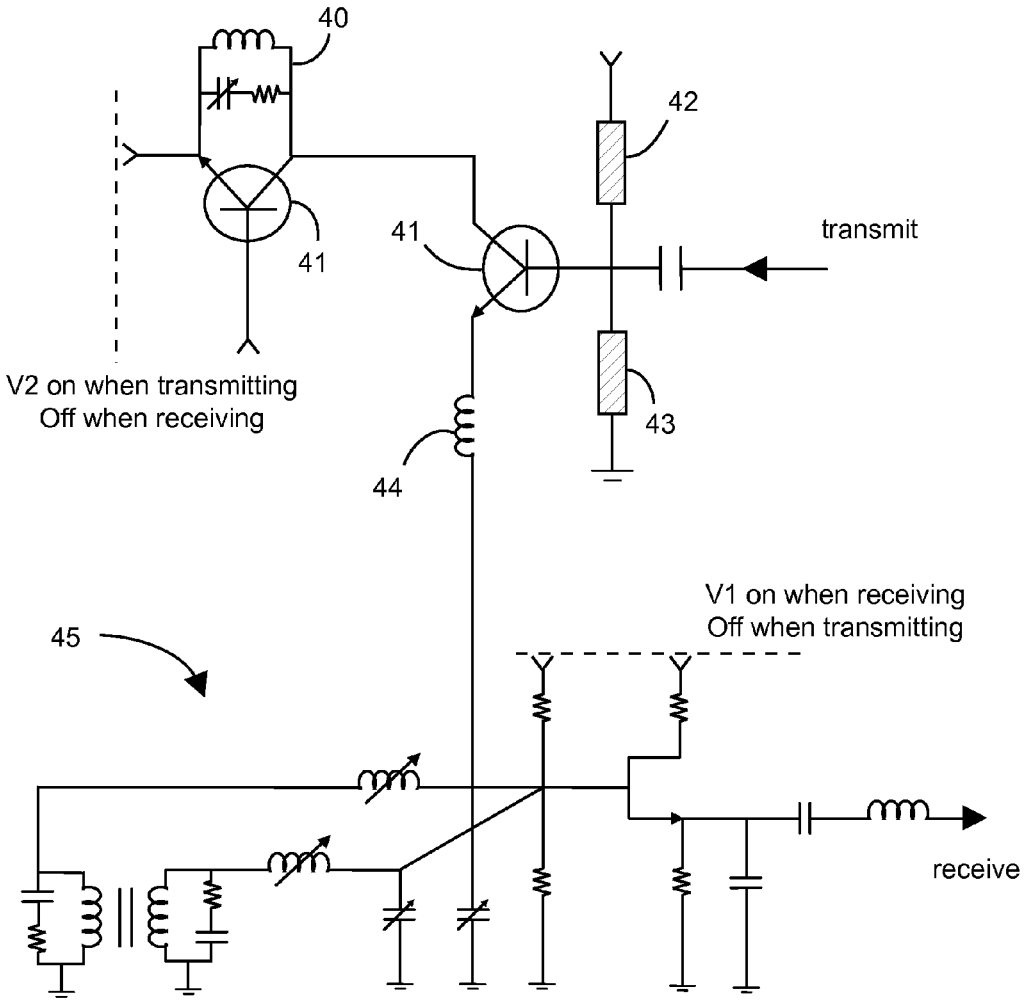
FIG. 6 illustrates an active antenna circuit not requiring switches to isolate transmitter and receiver. This active antenna provides operation of either transmit or receive function at a given time. The supply voltage is switched on or off for the transmit or receive sections when needed.

FIG. 6 illustrates a circuit where a tunable antenna 40 is connected to an active impedance transformer 41, the active impedance transformer 41 is further connected to a transmitter and biased with impedances 42 and 43. An inductor 44 is used to de-couple the active transmit antenna from the active receive antenna 45, which was; wherein active receive antenna 45 is substantially as shown and described in FIG. 5 and the above descriptions associated therewith.

Figure 7:
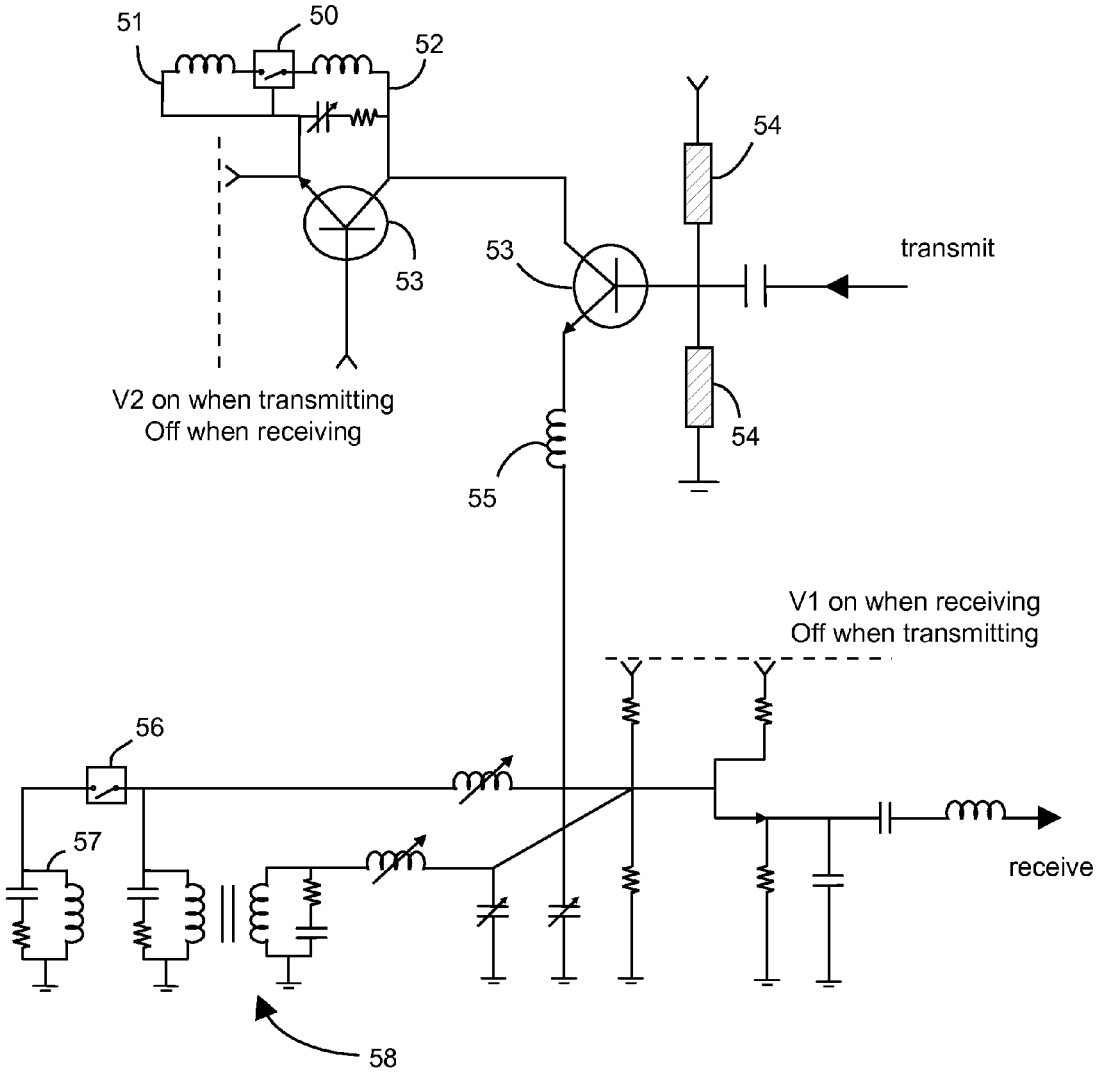
FIG. 7 illustrates an extension of the circuit shown in FIG. 6 to provide multi-frequency transmit and receive operation. Multiple elements in the tunable antenna can be switched into the circuit to extend the frequency range of the antenna system.

FIG. 7 illustrates an extension of the circuit described in FIG. 6 which provides additional capability with regards to bandwidth. A switch 50 is used to connect an additional antenna element 51 to extend the tuning range of the tunable antenna 52. This tunable antenna assembly is connected to an active impedance transformer 53 which is connected to a transmitter and biased with impedances 54. An inductor 55 is used to de-couple the active transmit antenna from the active receive antenna. The active receive antenna has a switch 56 and additional antenna element 57 connected to the tunable antenna 58 as shown in the related embodiment of FIG. 6. The additional antenna element 57 provides additional tuning bandwidth for the receive antenna.

Figure 8:
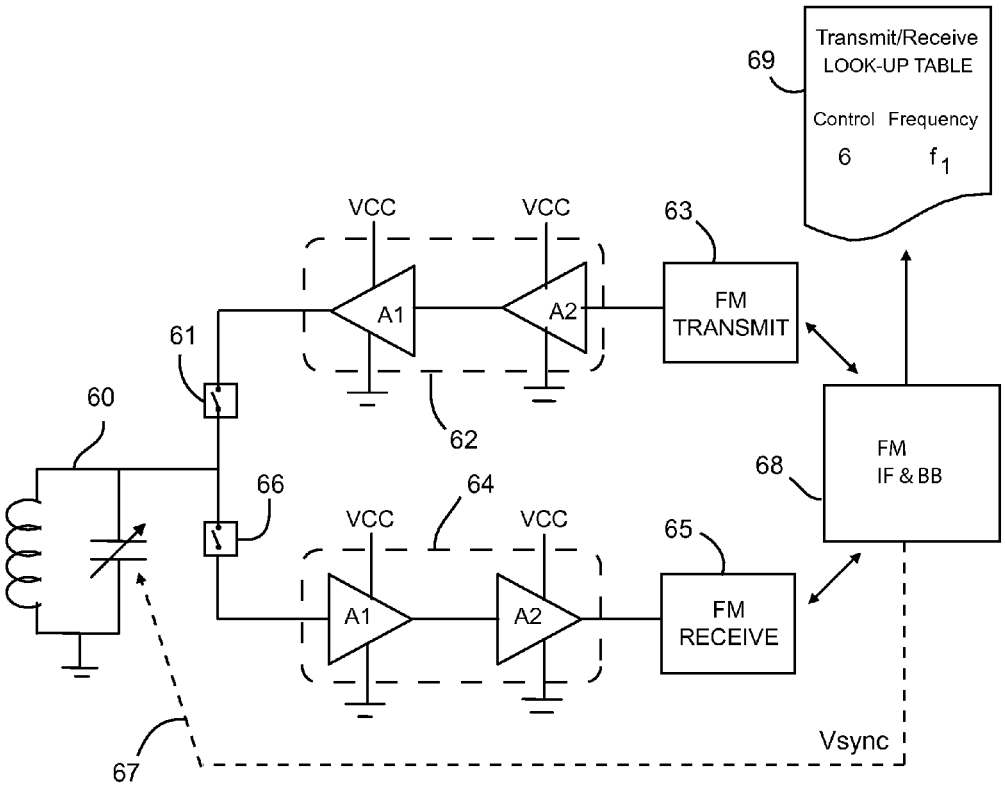
FIG. 8 illustrates an active transmit and receive antenna configuration that utilizes the same tunable antenna for both transmit and receive functions. A control signal Vsync is sent from the FM IF Baseband (BB) unit to tune the active or tunable element based upon a look-up table.

FIG. 8 illustrates an active antenna system that utilizes the same tunable antenna for both transmit and receive functions. A tunable antenna 60 is connected to two switches 61 and 66. Switch 61 connects the tunable antenna to an active impedance transformer 62 and an FM transmitter 63. Switch 66 connects the tunable antenna to an active impedance transformer 64 and an FM receiver 65. The active impedance transformer 62 is optimized to impedance match the tunable antenna 60 to the FM transmitter 63. The active impedance transformer 64 is optimized to impedance match the tunable antenna 60 to the FM receiver 65. This configuration provides optimal power transfer for both transmit and receive functions. A control signal Vsync 67 is sent from the FM IF Baseband (BB) unit to tune the active or tunable element based upon a look-up table 69.

The invention claimed is:

1. An antenna system configured for simultaneous transmit and receive function, comprising:

a transmit section, the transmit section comprising a first antenna;

a receive section, the receive section comprising a second antenna, wherein the receive section is distinct from the transmit section;

a switch assembly coupled to each of the transmit section and the receive section, the switch assembly being further coupled to a transceiver and configured to provide isolation between transmit and receive signals being exchanged between the transceiver and each of the transmit section and the receive section;

wherein the antenna system is capable of simultaneous transmit and receive operation.

2. The antenna system of claim 1, wherein at least one section of the transmit and receive sections comprises two or more tunable antennas.

3. The antenna system of claim 1, wherein at least one of the first and second antennas comprises: a monopole, Inverted F antenna (IFA), Planar Inverted F Antenna (PIFA), Isolated Magnetic Dipole (IMD) element, or a dipole.

4. The antenna system of claim 1, wherein said first and second antennas comprise tunable antennas; wherein said tunable antennas each comprises a radiating conductor and a tunable component connected therewith, said tunable component configured to vary a reactance of the respective antenna.

5. The antenna system of claim 1, further comprising a noise matching module disposed between said switch assembly and said transceiver, said noise matching module comprising one or more impedance transformers configured to impedance match each of said transmit and said receive sections with said transceiver.

6. The antenna system of claim 5, further comprising an FM transmit/receive module disposed between said noise matching module and said transceiver, said FM transmit/receive module coupled to each of the first and second antennas, and further coupled to the switch assembly, wherein said FM transmit/receive module is thereby configured to control transmit and receive operation using control signals communicated therewith.

7. The antenna system of claim 6, wherein said FM transmit/receive module is configured to communicate a transmit/receive command to the switch assembly for controlling transmit and receive function of the antenna.

8. An antenna system, comprising:

a transmit section and a receive section;

said transmit section comprising at least:

a first tunable antenna coupled to a first active impedance transformer module;

said first active impedance transformer module being further coupled to a transmitter, wherein said first active impedance transformer is configured with one or more impedance biases at a transmitter side thereof; and said receive section comprising at least:

a second tunable antenna and a third tunable antenna, each of the second and third tunable antennas being tuned for a desired frequency response and collectively configured to receive signals within a desired bandwidth;

each of the second and third tunable antennas being further coupled to a second impedance transformer;

said second impedance transformer being further coupled to a receiver;

wherein said transmit section is coupled to said receive section; and wherein an inductor is disposed between said transmit and receive sections for decoupling the first tunable antenna of the transmit section from the antennas of the receive section.

9. The antenna system of claim 8, said first tunable antenna comprising a first antenna element coupled to a second antenna element at a switch, wherein said first tunable antenna is configured for actively varying a tunable range thereof.

10. The antenna system of claim 8, wherein said receive section comprises three or more tunable antennas, wherein said second and third tunable antennas are coupled to a fourth tunable antenna at a switch disposed therebetween.

11. The antenna system of claim 8, wherein a first control signal is provided to the first tunable antenna of the transmit section during transmission.

12. The antenna system of claim 8, wherein a second control signal is provided to the antennas of the receive section when receiving.

13. An antenna system, comprising:

a transmit section and a receive section;

the transmit section comprising a first active impedance transformer coupled to a transmitter;

the receive section comprising a second active impedance transformer coupled to a receiver; and a tunable antenna comprising a voltage-controlled tunable component, the tunable antenna being coupled to each of the transmit and receive sections at a switch assembly therebetween.

14. The antenna system of claim 13, comprising a baseband control module configured to communicate control signals to one or more of the switch assembly and the tunable antenna.

* * * * *